United States Patent [19]

Becker et al.

[11] Patent Number: 4,597,743

[45] Date of Patent: Jul. 1, 1986

[54] FREE-STANDING ROLLING BOOK FOR CHILDREN

[76] Inventors: James Becker, 145 Hart Ave., Santa Monica, Calif. 90405; Andrew S. Mayer, 747 Gayley Ave., Apt. 3, Los Angeles, Calif. 90024

[21] Appl. No.: 724,776

[22] Filed: Apr. 18, 1985

[51] Int. Cl.[4] ..... A63H 00/00

[52] U.S. Cl. ..... 446/71; 281/15 R; 446/147; 446/469

[58] Field of Search ..... 446/71, 78, 147, 469; 281/1, 15 R

[56] References Cited

U.S. PATENT DOCUMENTS 3,456,380 7/1969 Cameron ..... 281/15 R X 3,474,563 10/1969 Boster ..... 446/78

FOREIGN PATENT DOCUMENTS 295110 2/1954 Switzerland ..... 446/78

*Primary Examiner*—F. Barry Shay

*Attorney, Agent, or Firm*—Knobbe, Martens, Olson & Bear

[57] ABSTRACT

A free-standing rolling book comprises plural sheets, bound along one marginal edge. In the preferred embodiment, the book cover includes printed matter depicting a wheeled vehicle having wheel wells disposed adjacent the bottom edge of the book. Respective wheels are rotatably cantilever mounted at each of the wheel wells. The dimensions of the sheets and the wheel span of the wheels are selected such that the wheels support the sheets in a free-standing position so as to permit the book to roll without external support. The wheel span should be at least two-sevenths of the distance between the center of gravity of the book and the wheel-supporting surface, and, in the preferred embodiment, is one-seventh of the book's height.

12 Claims, 5 Drawing Figures

FREE-STANDING ROLLING BOOK FOR CHILDREN

BACKGROUND OF THE INVENTION

The present invention relates to children's books and particularly to children's books having entertainment features.

It is sometimes difficult to interest young children in reading books. The prior art has addressed this problem by designing children's books so that they are visually attractive and have eye-catching features. While visual attraction may be sufficient to initially interest the child, there is a need in the art for a book which incorporates structural features which permit the book to function as a toy, so as to maintain the child's interest over a long period of time.

SUMMARY OF THE INVENTION

The present invention comprises a book having printed matter, preferably on both the front and back covers, depicting a vehicle or other moving object, such as an animal. The object depicted by the printed matter has support locations where the moving object is normally supported on the ground. In the case of a wheeled vehicle, the support locations comprise the wheel wells of the vehicle. In the case of non-wheeled vehicle, such as a sled, the support locations comprise the runners of the sled. In the case of animals, the support locations comprise the feet of the animals.

The book of the present invention also includes plural wheels, each of which is rotatably mounted at a support location depicted by the printed matter. The wheels are cantilever mounted to project from the front and back covers of the book so that the book can be opened to expose the interior pages without interference by the wheels. Preferably, the front and back covers each have two such wheels, namely, a front wheel, and a rear wheel. The front wheel on the front cover is preferably aligned with the front wheel on the back cover so that their axes of rotation are along a common line normal to the front and back covers. Similarly, the rear wheels on the covers are aligned so that their axes of rotation are along a common line normal to the front and back covers.

The size of the wheels, and the height and thickness of the book are all selected to provide stability, such that the book is free-standing, and self-rolling. In other words, the book stands by itself on its wheels without external support, and also rolls by itself on its wheels, e.g., when placed on an inclined plane. It has been found that these free-standing, self-rolling features of the book of the present invention are quite important to the enjoyment of the book by the child. The dimensions of the book and the size of the wheels are selected such that the wheel span (i.e., the distance between the outer edge of a wheel on the front cover and the outer edge of the corresponding wheel on the back cover, measured in a direction normal to the covers) is at least two-sevenths of the distance between the center of gravity of the book and a flat surface on which the wheels rest. If the book is generally rectangular, as in the preferred embodiment, the wheel span is preferably selected such that it is at least one-seventh of the book's height.

The book of the present invention preferably includes means for selectively fastening the covers of the book together to maintain the book in a closed condition during rolling on the wheels. In the preferred embodiment, the fastening means comprises a strap, one end of which is permanently affixed to one of the covers, while the other end has a snap for detachably engaging the other cover.

In the preferred embodiment, the front and back covers are the same size and thickness as the interior pages. Further, the covers and interior pages are preferably sculptured to generally follow at least a portion of the outline of the vehicle or other moving object depicted by the printed matter, so as to give the book three-dimensional realism.

In the book of the disclosed embodiment, the ground clearance (i.e., the distance between the bottom of the book and a flat surface on which the book is placed in a free-standing, rolling position) is no more than one-quarter inch. This advantageously provides a low center of gravity for the book, thereby increasing its stability, while still providing sufficient clearance for the book to roll.

DESCRIPTION OF THE DRAWINGS

These and other advantages of the present invention may be more fully understood through reference to the drawings in which.

DETAILED DESCRIPTION OF THE PREFERRED EMBODIMENT

Figure 1:
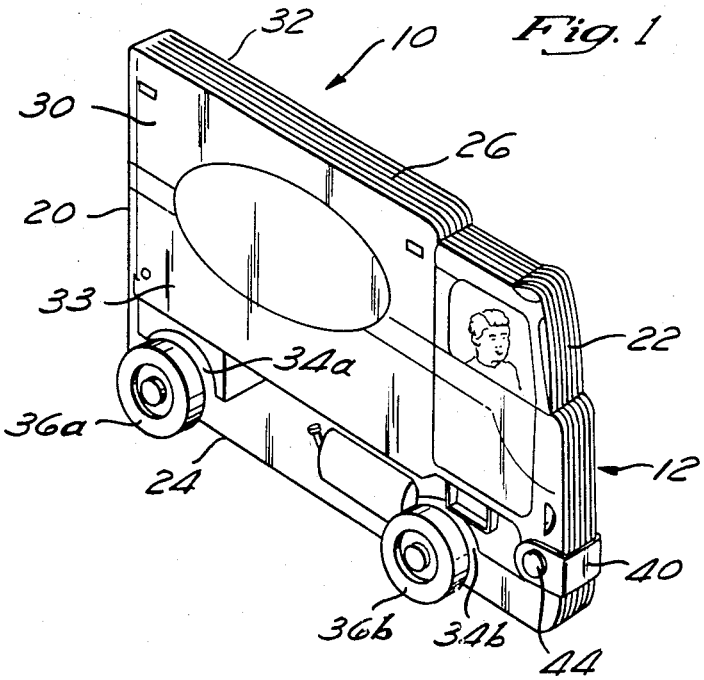
FIG. 1 is a perspective view of the book of the present invention, showing the printed matter on the front cover, with the book in a closed condition for rolling.
Figure 2:
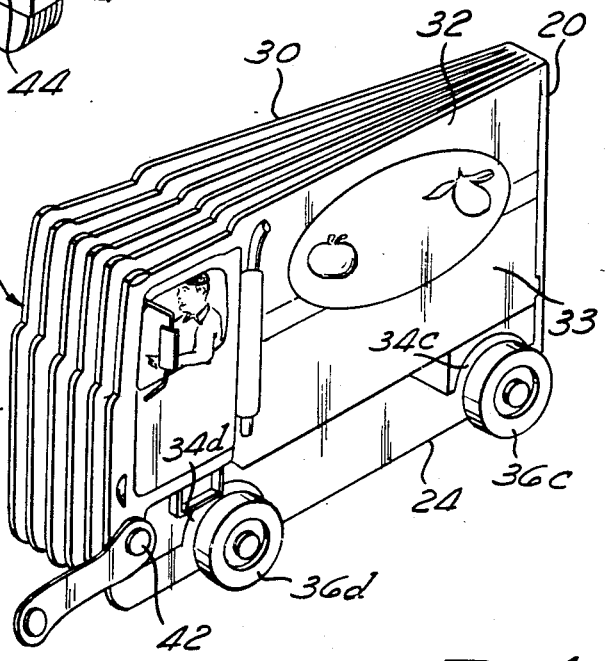
FIG. 2 is a perspective view of the book showing the book in an open condition for exposing the interior pages for reading.

As shown in FIGS. 1 and 2, the free-standing rolling book 10 of the present invention comprises plural, generally rectangular sheets 12, each having four marginal edges, 20, 22, 24, and 26 with the edges 20 and 22 forming the sides of the book 10, and the edges 24 and 26 forming the bottom and top, respectively, of the book 10. The sheets 12 of the book 10 are bound, e.g., along the marginal edges 20. In the embodiment shown, the sheets 12 of the book 10 are structurally identical. By way of specific example, the sheets 12 may be about 6½ inches in height by 4¼ inches in width and the pages 12 may be formed from 1/16 inch cardboard.

The two outermost sheets 12 form a front cover 30 and a back cover 32, while the interior sheets form the pages of the book 10. Both the front cover 30 and the back cover 32 have printed matter thereon depicting a moving object, which, in the preferred embodiment, comprises a vehicle 33. Although the printed matter 33 in the embodiment disclosed comprises a truck, it will be understood that other types of vehicles, such as cars, fire engines and sleds, may be alternatively depicted. Further, it will be recognized that printed matter 33 may alternatively comprise moving objects other than vehicles, such as animals. Comparing FIG. 1 with FIG. 2, it will be seen that the printed matter 33 on the back cover 32 shows the opposite side of the object depicted by printed matter 33 on the front cover 30. Regardless of the type of moving object depicted, the printed matter 33 includes support locations for supporting the moving object on the ground. The support locations on the front cover 30 are designated generally in FIG. 1 by the reference numerals 34*a*, 34*b*, while those on the back cover 32 are designated generally in FIG. 2 by reference numerals 34*c*, 34*d*. In the case of a wheeled vehicle, the support locations 34 comprise the wheel wells of the wheeled vehicle. In the case of a non-wheeled vehicle, such as a sled, the support locations comprise the normal ground contact points, that is, the runners of the sled. In the case of an animal, the support locations 34 comprise the feet of the animal. In all cases, however, the printed matter is disposed so that the support locations 34 are located adjacent the bottom marginal edge 24 for both covers 30, 32. Further, the bottom marginal edge 24 is preferably longer than the side marginal edges 20, 22.

As shown in FIGS. 1 and 2, the book 10 of the present invention includes wheels 36*a*, 36*b*, which are mounted at the support locations 34*a*, 34*b*, respectively, on the front cover 30. Similarly, wheels 36*c*, and 36*d* are mounted at the wheel locations 34*c*, 34*d*, respectively, on the back cover 32. The wheels 36*a*, 36*c* are directly opposite each other so as to form a rear wheel pair for the vehicle 33, and the wheels 36*b*, 36*d* are directly opposite each other so as to form a front wheel pair for the vehicle 33.

The wheels 36*a*, 36*b* are cantilever mounted on the front cover 30, so as to project outwardly therefrom. Similarly, the wheels 36*c*, 36*d* are cantilever mounted on the rear cover 32, so as to project outwardly therefrom. All of the wheels 36 are mounted on respective axles to freely rotate about respective axes formed by the axles. The axes of rotation for the front wheel pair 36*b*, 36*d* lie along a common line which passes through the interior pages 12 as well as the covers 30, 32. Likewise, the axes of rotation of the rear wheel pair 36*a*, 36*c* lie along a second common line which passes through the interior pages 12 as well as the covers 30, 32. Thus, the wheels 36 of each of the two wheel pairs rotate as if they were mounted on a common axle. However, by cantilever mounting the wheels, rather than actually mounting them on a common axle, the covers 30, 32 are freely moveable relative to each other, and relative to the interior pages or sheets 12. Thus, the cantilever mounting of the wheels 36 advantageously permits the book to be opened in a normal manner to expose the interior pages, without interference by the wheels.

Figure 1A:
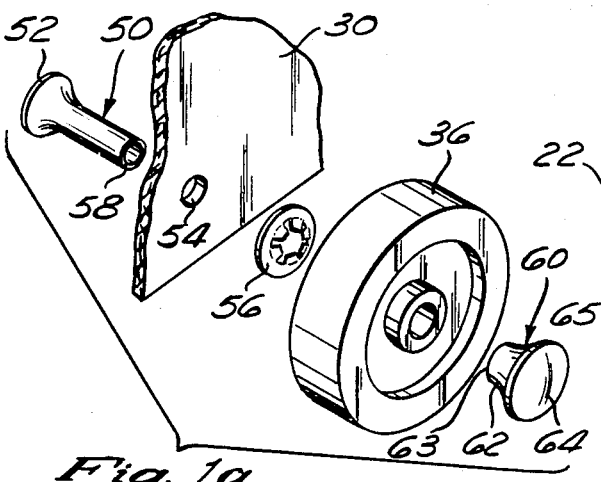
FIG. 1*a* is an enlarged exploded view of an exemplary one of the wheels of FIG. 1, showing the manner in which the wheels are cantilever mounted.

The aforementioned cantilever mounting is illustrated in FIG. 1*a* for an exemplary one of the wheels 36 on the cover 30. As shown therein, the wheel axle is formed by a tubular, cylindrical post 50, having a flanged portion 52 at one end. Except for the flanged portion 52, the post 50 has a uniform diameter throughout its length. The post 50 is inserted into an aperture or hole 54 formed in the book cover 30 such that the flanged portion 52 is on the inside of the book cover. In the preferred embodiment, the hole 54 is approximately the same diameter as the post 50. A splined washer 56 is then inserted onto the post from the end portion 58 opposite the flanged portion 52 such that the washer abutts the outside of the book cover 30. thus, the washer 56 and flanged portion 52 cooperate to sandwhich the cover 30 therebetween, and thereby cantilever mount the post 50 to project outwardly from the cover 30. the splines are formed by cutting the washer material along plural lines which project radially outwardly from the central aperture of the washer, towards the periphery of the washer, but stopping short of the outer marginal edge of the washer 56. The central aperture of the washer 56 is slightly smaller than the end portion 58 of the post 50, and the washer 56 is formed of a spring-like material, such as spring steel, so that during insertion of the washer 56 onto the post 50, the splines spread and bend outwardly towards the end 58 to prevent reverse movement of the washer 56. In other words, the splines provide a spring force against the sides of the post 50, so that the washer slides freely when pushed towards the flanged portion 52, but will not slide in the opposite direction, i.e. towards the end 58. Thus, the washer 56 functions as a one way, push on, locking device for cantilever mounting of the post 50. Advantageously, when the washer is pushed against the cover 30, the spreading of the splines forms a hub means which creates a neck or hub, adjacent to the post 50, which projects in a direction normal to the plane of the washer 56 towards the end 58 of the post 50. The wheel 36 is then mounted on the post 50 by inserting the central aperture of the wheel onto the end 58 and sliding the wheel 36 against the hub formed by the splines of the washer 56. The hub advantageously spaces the wheel 36 from the cover 30 so that the wheel 36 does not rub against the cover 30 during rotation, and thus, the hub permits the book to roll freely on the wheel 36 with very little friction. Finally, a cap 60 having a tubular neck portion, is placed on the end 58. The neck portion 62 has a small end 63 which is sized to receive the end 58 of the post 50, and a large end 65. The cap 60 also includes a roof portion 64, which closes the large end 65 of the cap 60. After the cap 60 is placed on the end 58, the tubular material at the end of the post 50 is peened over to enlarge the end 58 to a diameter greater than that of the end 63 of the neck portion 62, thereby permanently fastening the cap to the post 50 to prevent removal of the cap 60. Such peening is accomplished by applying a longitudinal force to the post 50 by squeezing the post 50 between the roof portion 64 of the cap 60 and the flange portion 52 of the post 50.

Figure 3:
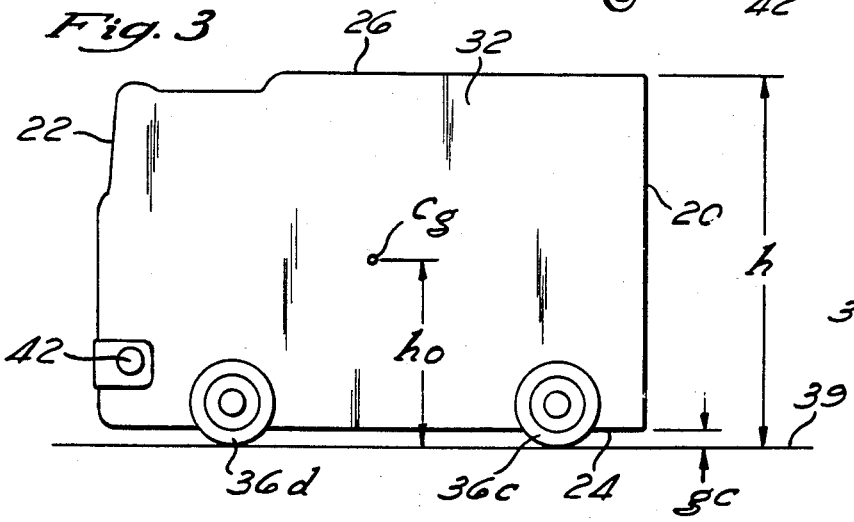
FIGS. 3 and 4 are elevational views of the book illustrating the book's dimensions and the relationship of the dimensions necessary to yield the preferred stability for the book.
Figure 4:
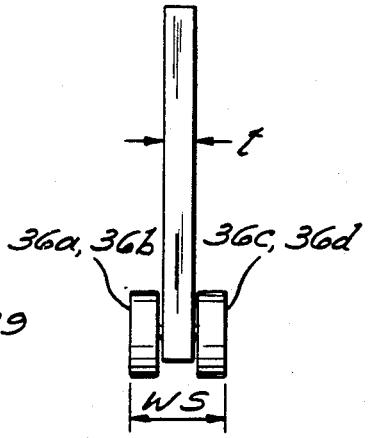

The dimensions of the book 10 are selected to cooperate with the size and location of the wheels to provide stability for the book 10, so that it is free-standing, and rolls by itself without need for external support. The factors necessary for properly dimensioning the book 10 will be described in reference to FIGS. 3 and 4. FIG. 3, which is an elevation view of the free-standing book 10, illustrates the back cover 32, and wheels 36*c*, 36*d* which are mounted thereon. Although no printing is shown on the back cover 32 in FIG. 3, it will be understood that the cover 32 preferably does include printing showing the opposite side of the moving object depicted on the front cover 30 of FIG. 1.

As shown in FIG. 3, the book 10 has an overall height, h, which is the distance between the top of the book and a flat surface 39 on which the wheels 36 rest. The book 10 also has a ground clearance dimension, labeled gc, which is the distance between the bottom marginal edge 24 and the surface 39 on which the wheels 36 rest. For stability it is important that the ground clearance gc be small, and, preferably the dimension gc is no more than $\frac{1}{4}$ inch. The height, h, should be selected with reference to the wheel span of the wheels 36, labeled as the dimension ws in FIG. 4. The terms wheel span, as used herein, is defined as the distance between the outer edges of a wheel mounted on the front cover and the outer edges of a wheel mounted on the back cover, measured in a direction normal to the covers. In the embodiment shown, the wheel span is the distance between the outer edges of a wheel pair (e.g., front wheel pair or the back wheel pair). To insure sufficient stability, the height, h, of the book should preferably be no more than about seven times the dimension ws. In the embodiment disclosed, the height, h, is about four times the wheel span ws. It should be noted that the wheel span dimension ws depends not only upon the thickness of the wheels, but also on the thickness of the book, labeled "t" in FIG. 4, such that the wheel span ws is approximately equal to twice the wheel thickness plus the book thickness.

It will be understood that the above described relationship between the height h and the wheel span ws applies principally to generally rectangular books, such as the preferred embodiment, which has a center of gravity substantially at the geometric center of the book. If the book is not rectangular, a more general approach, applicable to all book shapes, must be used. Under this generalized approach, the dimension ws should be selected in reference to the distance between the center of gravity (labeled cg in FIG. 3) and the ground surface 39. Such distance is designated by the dimension $h_0$ in FIG. 3. Specifically, the dimension ws should preferably be at least two-sevenths of the dimension $h_0$. Note that the center of gravity of the book 10 may be approximately located by balancing the book on a pointed object, such as a person's finger, such that the axis of the object is normal to the planes of the book covers 30, 32. It has been found that selecting the dimensions of the book and the size and location of the wheels in this manner provides sufficient stability so as to enable the book 10 to be free-standing and to roll by itself.

In the preferred embodiment, the book 10 also includes a locking apparatus for selectively locking the sheets 12 together to prevent the sheets from separating when the book is rolling. The locking apparatus detachably fastens the front cover 30 to the back cover 32, e.g., by means of a strap 40 which is permanently affixed to the back cover 32 by a rivet 42, and detachably affixed to the front cover 30 by a snap 44. The snap 44 permits the strap to be selectively engaged and disengaged so that the book may be alternatively selectively locked or unlocked.

As best seen in FIG. 1, the marginal edges 22, 26 of the book 10 of the preferred embodiment are also preferably sculptured to generally follow the contour of the moving object depicted by the printed matter 34 to enhance three-dimensional realism.

The present inve ntion thus not only provides an attractive book, but also a functioning, realistic toy which may be enjoyed by a child apart from the textual matter in the book. This not only enhances the child's interest in the book, but also enhances his enjoyment of the book.

What is claimed is:

1. A free-standing rolling book comprising:

plural sheets, bound along one marginal edge to form said book, said sheets including a front cover and a back cover with interior pages therebetween;

printed matter, disposed on the exterior of at least one of said covers, depicting a moving object having support locations, said support locations disposed adjacent a bottom marginal edge of said at least one of said covers;

plural wheels, for supporting said sheets in a free-standing position when all of said sheets are vertical and in contact with adjacent sheets such that said book is in a closed upright position, at least some of said wheels disposed at respective support locations depicted by said printed matter; and means for individually, rotatably, cantilever mounting said wheels along respective axes passing through the covers of the book such that said wheels project outwardly in cantilever fashion from said front and back covers to permit said book to be opened to expose the interior pages thereof, said wheels being mounted in positions so related to the center of gravity of said book and being configured to provide a wheel span, between the outer edge of a wheel mounted on said front cover and the outer edge of a wheel mounted on said back cover, measured in a direction normal to said covers, such that said mounting and configuration enable the rotatably mounted wheels to support said sheets in said free-standing position to permit said book to roll without external support.

2. A free-standing rolling book, as defined by claim 1, wherein said moving object depicted by said printed matter comprises a wheeled vehicle, and said wheel locations depicted by said printed matter comprise the wheel wells of said wheeled vehicle.

3. A free-standing rolling book, as defined by claim 1, additionally comprising means for detachably fastening said sheets together to prevent said sheets from separating while said book is rolling on said rotatably mounted wheels.

4. A free-standing rolling book, as defined by claim 3, wherein said fastening means comprises a strap, permanently affixed to one of said covers, and detachably affixed to the other of said covers.

5. A free-standing rolling book, as defined by claim 1, wherein said front cover, back cover, and interior pages have the same dimensions.

6. A free-standing rolling book, as defined by claim 5, wherein at least one of the marginal edges of said sheets is sculptured to generally follow the contour of at least a portion of the periphery of the moving object depicted by said printed matter to enhance the three-dimensional realism of said book.

7. A free-standing rolling book, as defined by claim 1, wherein said plural wheels comprise at least four wheels, two of which are cantilever mounted on said back cover and two of which are cantilever mounted on said front cover, one of said wheels on said front cover disposed adjacent to one of said wheels on the back cover to provide a front wheel pair, and the other of said wheels on the front cover disposed adjacent the other of said wheels on the back cover to provide a rear wheel pair.

8. A free-standing rolling book, as defined by claim 7, wherein the axes of rotation of the wheels comprising said front wheel pair lie along a common line and the axes of rotation of the wheels comprising said rear wheel pair lie along a common line, said common lines passing through the interior pages of said book.

9. A free-standing rolling book, as defined by claim 1, wherein said wheel span is at least two-sevenths of the distance between the center of gravity of said book and a surface on which said wheels rest.

10. A free-standing rolling book, as defined by claim 9, wherein said book is generally rectangular, and said wheel span is at least one-seventh of the distance between a surface on which the wheels rest and the top of said book.

11. A free-standing rolling book, as defined by claim 1, wherein the ground clearance distance between said covers and a surface on which said wheels rest is no greater than $\frac{1}{4}$ inch.

12. A free-standing rolling book, as defined by claim 1, wherein said cantilever mounting means comprises hub means for spacing said wheels from said covers to prevent said wheels from rubbing against said covers during rotation.

* * * * *